United States Patent [19]

Trantow

[11] 4,353,404

[45] Oct. 12, 1982

[54] JOINTED VERTICAL SLAT FOR WINDOW BLIND

[75] Inventor: Mark D. Trantow, Wausau, Wis.

[73] Assignee: Wausau Metals Corp., Wausau, Wis.

[21] Appl. No.: 230,693

[22] Filed: Feb. 2, 1981

[51] Int. Cl.[3] ..... E06B 3/12

[52] U.S. Cl. ..... 160/236; 160/166 A; 160/332

[58] Field of Search ..... 160/229 R, 236, 332, 160/166 A; 52/245, 342, 726

[56] References Cited

U.S. PATENT DOCUMENTS

| | | | |
|---|---|---|---|
| 291,254 | 1/1884 | Williams | 160/236 |
| 1,230,271 | 6/1917 | Bruggeman | 160/332 |
| 2,175,259 | 10/1939 | Erickson | 160/229 R |
| 2,188,575 | 1/1940 | McLennan | 160/166 A |
| 2,275,975 | 3/1942 | McGlone | 160/236 |
| 2,524,372 | 3/1950 | Bopp et al. | 160/166 |
| 2,529,714 | 11/1950 | Turkowski | 160/166 |
| 2,561,206 | 7/1951 | Kasper | 160/229 R |
| 2,612,220 | 9/1952 | Turkowski | 160/166 |
| 2,809,848 | 10/1957 | Carswell | 160/229 R |
| 2,828,816 | 4/1958 | Nestor | 160/166 |
| 3,106,240 | 10/1963 | Weber | 160/236 |
| 3,499,477 | 3/1970 | Niwa | 160/166 |
| 3,921,694 | 11/1975 | Galex | 160/166 |
| 4,006,769 | 2/1977 | Woodle | 160/166 |

*Primary Examiner*—Peter M. Caun

*Attorney, Agent, or Firm*—Isaksen, Lathrop, Esch, Hart & Clark

[57] ABSTRACT

A window blind slat having a longitudinal axis includes a number of substantially flat, rigid, vertically extending slat sections, including at least a top slat section and a bottom slat section, each having a vertical, substantially planar face, an upper end and a lower end and means hinging the lower end of one slat section to the adjacent upper end of the next lower slat section, the sections being disposed to one another such that the tendency of the slat to vary so as to distant the longitudinal axis of the slat will be rendered incapable of esthetically or functionally interfering with the performance of the slat.

3 Claims, 4 Drawing Figures

JOINTED VERTICAL SLAT FOR WINDOW BLIND

TECHNICAL FIELD

The present invention relates to slatted window blinds in general and, in particular, to vertically disposed slats for such blinds.

BACKGROUND OF PRIOR ART

The prior art is generally cognizant of window blinds utilizing vertical slats adapted to turn about their longitudinal axes. For typical examples see Woodle, U.S. Pat. No. 4,006,769; Galex, U.S. Pat. No. 3,921,694, and Takashi Niwa, U.S. Pat. No. 3,499,477. The vertically disposed slats may be made of a variety of materials, including rigid materials such as wood, plastic, or metal, and flexible materials such as fabrics. For an example of the latter, see Nestor, U.S. Pat. No. 2,828,816.

For esthetic reasons, among others, wooden slats are often preferred in window blinds. However, such slats are frequently subject to warping, being generally thin and long so that a great deal of surface is exposed to atmospheric changes. Furthermore, because of their considerable length, even slight warping per unit of length may have a significant cummulative effect, resulting in a visually objectionable distortion of the slats and also a disruption of their function, in that bowed slats fail to properly engage the edges of adjacent slats so as to screen out light or provide privacy. One response to the problem of warping is seen in McGlone, U.S. Pat. No. 2,275,975. In McGlone an effort is made to control the direction of the wood grain in the slats relative to the flat faces of the slats.

BRIEF SUMMARY OF THE INVENTION

The present invention is summarized in that a window blind slat having a longitudinal axis and adapted to be vertically disposed relative thereto includes a selected number of substantially flat, rigid, vertically extending slat sections, including at least a top slat section and a bottom slat section, each having a vertical, substantially planar face and an upper end and a lower end. Means are provided for joining the slat sections end-to-end in hinged relation, with the faces of the joined slat sections in substantially the same plane, the lower end of each slat section being joined to the upper end of any slat section immediately beneath it.

A primary object of the invention is to provide a window blind slat adapted to be virtually disposed in which the effects of any tendency of the slat to warp so as to distort the longitudinal axis of the slat will be rendered incapable of esthetically or functionally interfering with the performance of the slat.

A second object of the invention is to provide for a slat design such that wood and other materials subject to warping may nevertheless be successfully used for vertically disposed window blind slats.

Other objects, features, and advantages of the invention will be apparent from the following detailed description taken in conjunction with the accompanying drawings showing a preferred embodiment of a jointed, vertically disposed slat for a window blind exemplifying the principles of the invention.

DETAILED DESCRIPTION OF THE PREFERRED EMBODIMENT

Figure 1:
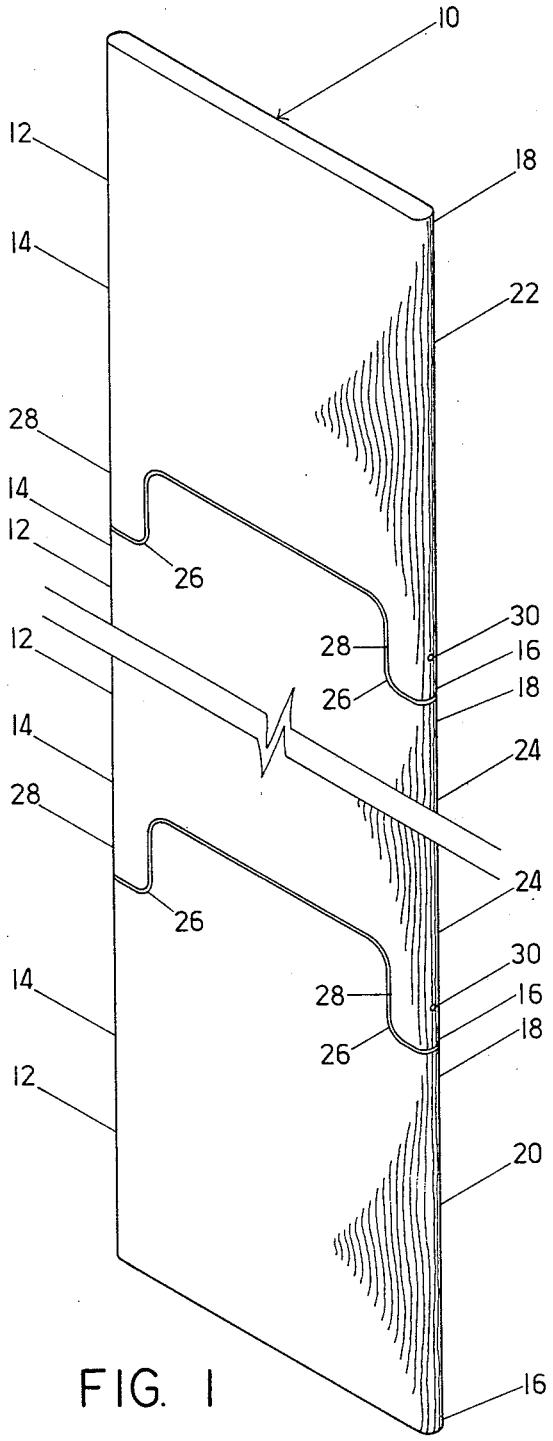
FIG.1 is a isometric perspective view of a window slat made in accordance with the invention.
Figure 2:
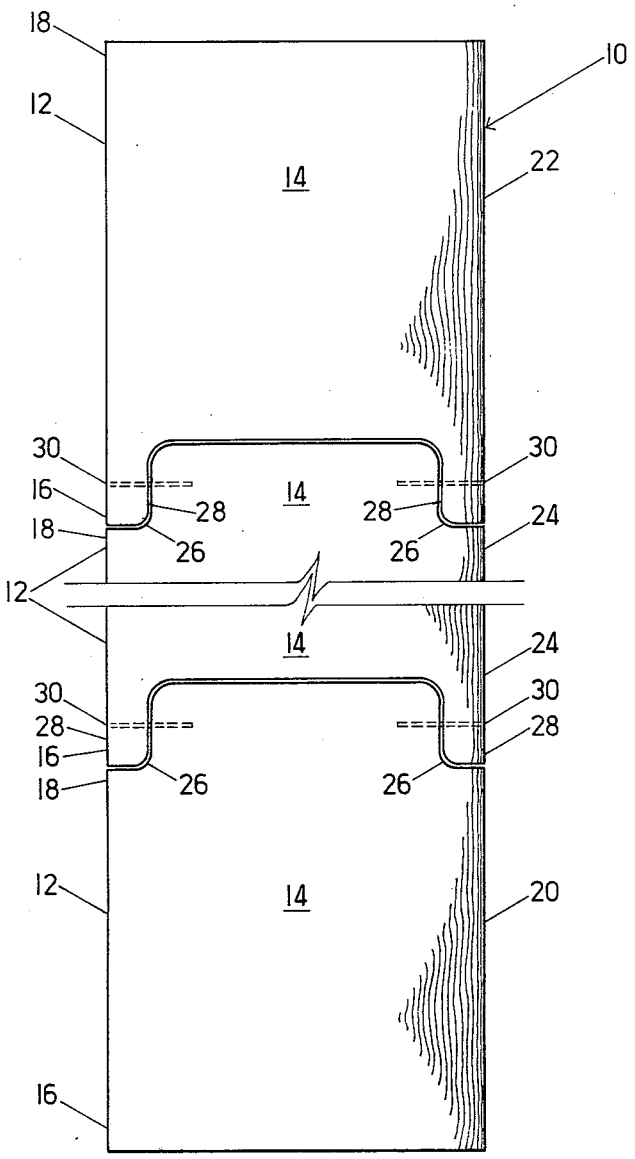
FIG. 2 is a front elevational view of the window blind slat of FIG. 1.
Figure 3:
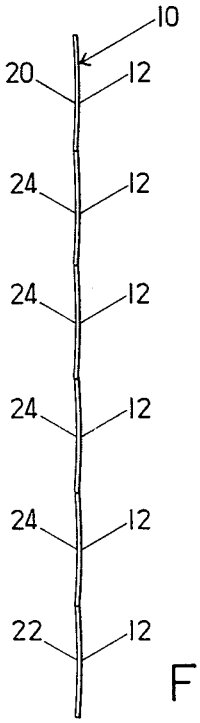
FIG. 3 is a side elevation view of the window blind slat of FIG. 1 in which each slat section is warped.

Referring more particularly to the drawings, wherein like numbers refer to like parts, FIGS. 1, 2, and 3 illustrate a preferred embodiment of the novel window blind slat of the invention, shown generally at 10. The window blind slat 10 is adapted to be vertically disposed. The slat 10 has a selected number of rigid, vertically extending slat sections 12. Each slat section 12 has a vertically disposed, substantially planar face 14 and a lower end 16 and upper end 18. The slat 10 includes a bottom slat section 20 and a top slat section 22, and may additionally include one or more intermediate slat sections 24 if the length of slat 10 so requires.

The window blind slat 10 of the invention has means for joining the slat sections 12 end-to-end in hinged relation, with the faces 14 of the slats oriented in substantially the same plane. In the preferred embodiment, the upper end 18 of the bottom slat section 20 and of each intermediate slat section 24 has surfaces defining at least one corner hinge slot 26. Each corner hinge slot 26 faces upwardly, extending downwardly from the upper end for a selected distance. The lower end 16 of the top slat section 22 and of each intermediate slat section 24 has at least one corner hinge tab 28. Each hinge tab 28 extends downwardly from the lower end 16 of the top or an intermediate slat section 22 and 24 for a selected distance to matably extend within the corner hinge slot 26 of the slat section 12 immediately below.

A hinge pin 30 shown in phantom in FIG. 2 passes through each corner hinge tab 28 and extends into the side of the corner hinge slot 26 with which the corner hinge tab is mated. Each hinge pin 30 extends substantially parallel to the faces 14 of the slat sections 12 and is oriented at right angles to the longitudinal axis of the slat 10. If any given slat section 12 has more than one corner hinge tab, all of the hinge pins 30 associated with that slat section are coaxial. Sufficient space is left between the slat sections 12 so that adjoining slat sections may freely turn on the hinge pins 30. Thus the slat sections 12 are jointed end-to-end in hinged relation, with the faces 14 of the slat sections in substantially the same plane. The lower end 16 of the top slat section 22 and of each intermediate slat section 24 is thus joined to the upper end 18 of the slat section immediately beneath it. Because the slat sections can move relative to each other only by turning on the hinge pins 30, which are oriented parallel to the plane of the faces 14, substantial relative movement of adjacent slat sections is impossible in a direction parallel to the plane of the faces, but other orientations of the hinge pins yielding other directions of possible movement are within the spirit and scope of the invention.

It is apparent that a person skilled in the art could contrive other arrangements of tabs, slots, and hinge pins whereby adjacent slat sections 12 could move relative to each other in the same manner. A hinge slot could be made to extend half way across the window blind slat with a single hinge pin holding adjacent sections together. Similarly, hinge slots could be downwardly facing to receive upwardly extending hinge tabs. The sides of hinge slots can extend first substantially parallel to and then at right angles to the axis of the slat, as shown in the preferred embodiment as set forth in FIGS. 1 and 2, or such slots could be inwardly or outwardly curved. Indeed, any shape by which parts of one slat section are adapted to extend vertically beyond parts of the adjacent slat section so that a hinge pin 30 extending substantially at right angles to the axis of the slat can join the two slat sections in hinged relation would be within the scope and spirit of the invention, as would the application of any conventional hinge so as to join adjacent slat sections in manner comparable to that described herein.

Figure 4:
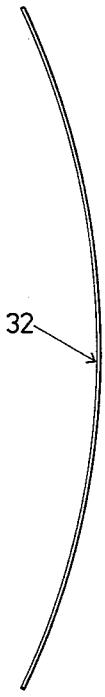
FIG. 4 is a side elevation view of a conventional window blind slat warped to the same degree as the slat of FIG. 3.

When a window blind slat is exposed to warping influences, it commonly tends to bow, so that the two ends of the slat are brought closer together and the face of the slat becomes curved, as is illustrated by the conventional slat shown at 32 in FIG. 4. In a window blind slat made in accordance with the invention, each slat section 12 is susceptible to such warping. However, because of the hinged relationship between successive slat sections 12, the effect of such warping is not cummulative. Instead, the slat as a whole remains substantially vertical, as gravity causes each section 12 to hang vertically from the hinge connecting it with the section next above, as is illustrated in FIG. 3, wherein the radius of curvature of each section 12 is the same as that of the warped conventional slat shown at 32 in FIG. 4. The length of the slat sections 12 may be selected to be short enough that, given the warping characteristics of the particular material used to make the slat sections, the distortion of any given section as a consequence of warping will be in an amount too small to interfer with the proper functioning of the slat.

The slat sections 12 may be made of wood or other suitable, rigid material and be formed by sawing, planing, sanding, laser cutting, and other conventional woodworking techniques. Hinge pins 30 can be conveniently made of metal and may be driven into place, preferably with holes predrilled to receive them.

It is understood that the invention is not confined to the particular construction, materials, and arrangement of parts herein illustrated and described, and that various changes may be made without departing from the spirit of the invention. The invention embraces all such modified forms thereof as come within the scope of the following claims.

What is claimed is:

1. In a window blind including a plurality of vertical wooden window blind slats (10), each window blind slat (10) having a vertical longitudinal axis, the improvement of each window blind slat comprising:

(a) a plurality of substantially flat, rigid, vertically extending slat sections (12), including at least a top slat section (22) and a bottom slat section (20), each slat section (12) having a vertical, substantially planar face (14) and an upper end (18) and a lower end (16); and (b) means for joining the slat sections (12) end-to-end in a hinged joint, with the faces (14) of the joined slat sections (12) in substantially the same plane, the lower end (16) of each slat section (12) being joined to the upper end (18) of any slat section (12) immediately beneath it, the hinged joint allowing pivotal movement between adjacent slat sections (12) only about a horizontal axis lying in the plane of the slat sections (12) so that each slat section (12) can independently hang vertically, so that the entire slat (10) appears vertical regardless of warping and bowing in any of the slat sections (12).

2. In a window blind the window blind slat (10) specified in claim 1 wherein the means for joining the slat sections (12) end-to-end in a hinged joint includes a selected lower part of a slat section (12) extending vertically beyond a selected upper part of the slat section (12) immediately beneath it, and a hinge pin (30) extending substantially at right angles to the longitudinal axis of the slat (10) and embedded in both the selected lower part and the selected upper part, the slat sections being adapted to turn about the hinge pin (30), whereby the two slat sections are joined in hinged relation.

3. In a window blind the window blind slat specified in claim 1 wherein the means for joining the slat sections (12) end-to-end in a hinged joint includes:

(a) in the lower end (16) of each slat section (12) from which another slat section (12) depends at least one hinge portion (28) extending downwardly from the lower end (16) for a selected distance; and (b) in the upper end (18) of each slat section (12) depending from another slat section (12) surfaces defining at least one hinge slot (26) facing upwardly and extending downwardly from the upper end (18) for a selected distance, each hinge portion (28) adapted to matably extend within the hinge slot (26) of the adjacent slat section (12) immediately below; and (c) hinge pins (30) extending substantially parallel to the faces (14) of the slat sections (12) and oriented at right angles to the longitudinal axis of the slat (10), a hinge pin (30) passing through each hinge portion (28) and extending into the side of the associated hinge slot (26) for a selected distance, the slat sections (12) being adapted to turn freely about the hinge pins (30).

* * * * *